US006601776B1

(12) United States Patent
Oljaca et al.

(10) Patent No.: US 6,601,776 B1
(45) Date of Patent: Aug. 5, 2003

(54) LIQUID ATOMIZATION METHODS AND DEVICES

(75) Inventors: Miodrag Oljaca, Avondale Estates, GA (US); Andrew Tije Hunt, Atlanta, GA (US); Brian T. Reese, Lakehurst, NJ (US); George Neuman, Ann Arbor, MI (US)

(73) Assignee: MicroCoating Technologies, Inc., Atlanta, GA (US)

( * ) Notice: Subject to any disclaimer, the term of this patent is extended or adjusted under 35 U.S.C. 154(b) by 73 days.

(21) Appl. No.: 10/070,958

(22) PCT Filed: Sep. 21, 2000

(86) PCT No.: PCT/US00/26211

§ 371 (c)(1),
(2), (4) Date: Jun. 6, 2002

(87) PCT Pub. No.: WO01/21319

PCT Pub. Date: Mar. 29, 2000

Related U.S. Application Data

(63) Continuation of application No. 09/401,435, filed on Sep. 22, 1999

(60) Provisional application No. 60/203,852, filed on May 13, 2000.

(51) Int. Cl.[7] ..... F02D 7/00; B05B 1/24

(52) U.S. Cl. ..... 239/5; 239/128; 239/130; 239/132; 239/135; 239/136

(58) Field of Search ..... 239/135, 128, 239/5, 132, 130, 133, 136

(56) References Cited

U.S. PATENT DOCUMENTS 2,416,256 A * 2/1947 Hochberg ..... 239/136
3,293,407 A * 12/1966 Ando ..... 138/33
3,408,007 A * 10/1968 Raichle et al. ..... 239/135
3,731,876 A * 5/1973 Showalter ..... 239/135
3,868,939 A * 3/1975 Friese et al. ..... 239/135
3,983,360 A * 9/1976 Offermann ..... 138/33
4,354,822 A * 10/1982 Madsen et al. ..... 239/135
5,159,915 A * 11/1992 Saito et al. ..... 239/128

* cited by examiner

*Primary Examiner*—Robin O. Evans
(74) *Attorney, Agent, or Firm*—Alfred H. Muratori; Wayne E. Nacker

(57) ABSTRACT

The present invention involves controlled atomization of liquids for various applications such as part/droplet seeding for laser-based measurements of flow velocity, temperature, and concentration; flame and a plasma based elemental analysis; nano-powder production; spray drying for generation of small-sized particles; nebulizers in the production of sub-micron size droplets and for atomizing fuel for use in combustion chambers. In these and other atomizer applications the control of droplet and/or particle size is very critical In some applications extremely small droplets are preferred (less than a micron), while in others, droplet diameters on the scale of several microns are required. The present invention has the flexibility of forming droplets within a particular range of diameters, wherein not only the size of the average droplet can be adjusted, but the range of sizes may be adjusted as well. The atomizer (4) itself is in the form of a heated tube (44) having an inlet end (48) and an outlet end (50). As liquid travels through the tube it is heated and upon exiting the tube and entering a reduced pressure area the liquid atomizes to form very fine droplets. By electrically heating the tube by passing a current therethrough, the heating adjustment can be performed on-the-fly allowing size adjustment during operation of the atomizer. Several different embodiments of the atomization device are disclosed.

48 Claims, 8 Drawing Sheets

LIQUID ATOMIZATION METHODS AND DEVICES

This application is a continuation of application No. 09/401,435, filed Sep. 22, 1999, and claims the benefit of provisional application 60/203,842, filed May 13, 2000.

FIELD OF THE INVENTION

The present invention is directed to methods and devices for atomizing liquids. More specifically, the liquids are atomized at the exit of an elongated, small diameter tube or a small internal surface area chamber, with an optional heating device for directly heating the liquid within the tube or chamber. The atomization devices are useful in many applications including, but are not limited to: flame and plasma based atomic spectroscopy, nano-powder production; particle/droplet seeding for laser-based flow diagnostics; spray drying for the production of fine powders; nebulizers for inhalation in delivery of medication and for atomizing fuel for use in combustion chambers.

BACKGROUND OF THE INVENTION

Atomizers are already used in many applications for producing finely divided aerosols with uniform droplet size distribution. While some of the prior art atomizers are at least partially effective, there is still a need for an atomizer that can produce a finely atomized spray with controlled and uniform droplet size distribution. The article on pages 2745–2749 of Analytical Chemistry 1990–62, entitled "Conversion of an Ultrasonic Humidifier to a Continuous-Type Ultrasonic Nebulizer for Atomic Spectrometry" and authored by Clifford et al., discusses the most commonly used solution nebulizers for atomic spectrometry. U.S. Pat. No. 4,582,731 issued on Apr. 15, 1986 to Smith, discloses a supercritical fluid molecular spray film deposition and powder formation method. The generation of particles and seeding in laser velocimetry is described by James F. Meyers in the von Karman Institute for fluid dynamics, lecture series 1991–08. This reference also discusses the increase in accuracy of laser measurements when uniform size particles are used. A nebulizer device for the delivery of medication is described in U.S. Pat. No. 5,511,726 issued to Greenspan et al. on Apr. 30, 1996. The device uses a piezo-electric crystal and control circuit to apply a voltage to a sprayed solution.

In addition to the above prior art atomizers, various methods and apparatus for preheating or atomizing fuel have been developed over recent years. While some of these devices are partially effective, there is still a need for an atomizer that can completely vaporize the fuel, as well as raise the temperature of the fuel to avoid condensation downstream of the atomizer. This is particularly useful during the cold start and warm-up cycle of an internal combustion engine. After an engine has been allowed to cool significantly below operating temperature (as little as several minutes after shutting it off, depending on the weather) and is then started, the fuel entering the combustion chamber is often in vapor, large droplet and liquid form. Large portions of the fuel that is in droplet or liquid form does not burn completely. This results in reduced engine efficiency (used but unburned fuel) and an increase in the production of unburned hydrocarbons. Not only is the engine not hot enough to effectively burn the non-atomized fuel, but the after-treatment (i.e. catalytic converter) is non-operational during this heavy pollution producing period of operation. In fact, seventy to eighty percent of all hydrocarbon emissions are generated prior to the catalytic converter coming on line. By decreasing the size of the fuel droplets and increasing the vaporization of the fuel entering the combustion chamber, the percentage of the fuel that is burned is increased, thereby producing more heat and reducing the time needed to bring the engine and catalytic converter to operating temperature.

U.S. Pat. No. 4,011,843 issued to Feuerman on Mar. 15, 1977, discusses vaporizing fuel for use in internal combustion engines. A spray valve for a fuel injected, IC engine is taught in U.S. Pat. No. 4,898,142, issued on Feb. 6, 1990 to Van Wechem et al. U.S. Pat. No. 5,118,451, issued on Jun. 2, 1992 to Lambert, Sr. et al. is drawn to another fuel vaporization device. In U.S. Pat. No. 5,609,297, issued on Mar. 11, 1997 to Gladigow et al., several embodiments of a fuel atomization device are described. A fuel injector with an internal heater is disclosed in U.S. Pat. No. 5,758,826, issued on Jun. 2, 1998 to Nines. U.S. Pat. No. 5,778,860, issued on Jul. 14, 1998 to Garcia, teaches a fuel vaporization system. SAE Technical Paper Series #900261 entitled "The Effect of Atomization of Fuel Injectors on Engine Performance", and written by Kashiwaya et al., discusses the use of injectors with swirl patterns. SAE Technical Paper Series #970040 entitled "Fuel Injection Strategies to Minimize Cold-Start HC Emissions", and written by Fisher et al., describes the effect of changing fuel injector and control parameters on cold-start emission levels. SAE Technical Paper Series #1999-01-0792 entitled "An Internally Heated Tip Injector to Reduce HC Emissions During Cold-Start", and written by Zimmermann et al., is drawn toward measuring the effect of internally heated fuel injectors on HC emissions prior to an engine reaching operating temperature.

SUMMARY OF THE INVENTION

The present invention involves controlled atomization of liquids for various applications such as particle/droplet seeding for laser-based measurements of flow velocity, temperature, and concentration; flame and plasma based atomic spectroscopy; nano-powder production; spray drying for generation of uniform-size powder; chemical processing (i.e. phase transformation, dispersions, catalysis, and fuel reformation); nebulizers for inhalation applications and for atomizing fuel for use in combustion chambers. In these and other atomizer applications the control of droplet and/or particle size and uniformity is critical. In some applications extremely small droplets are preferred (less than a micron), while in others, droplet diameters on the scale of several microns are required. However, most of the above-mentioned applications require finely dispersed spray with droplets sufficiently uniform in size (i.e. mono-dispersed). Other applications desire very fine droplets for increased surface area interaction for improved reactions, thermal and chemical equilibrium rates, phase transformations and uniformity. The atomizer of the present invention has the flexibility of forming droplets with controlled size, wherein not only the size of the average droplet can be adjusted, but the range of sizes may be adjusted as well. The methods of using the atomizer are described below with reference to the specific application.

The use of laser technology in the measurement community has increased significantly over the past few decades and continues to gain acceptance as new and improving technology evolves. An advantage of laser technology is that the light is non-intrusive and non-destructive and the condensed intensity inherent to laser beams allows for very accurate sensing of very small particles making very small changes. One such application is the use of laser beams to make velocity measurements, and is known as laser Doppler velocimitry (LDV). The laser beam is directed at moving particles, and the velocity of the particles is measured. Often, this type of measurement is used to study the velocity characteristics of a gas flow, such as air, through a duct. To provide an object for the laser beam to be reflected by in air and other gases, one must introduce some medium that is large enough to be illuminated. In demonstrations, this is typically accomplished with smoke. However, measurements such as LDV typically require a slightly larger particle in the sub-micron to several micron range. In addition to the size sensitivity, the reflecting medium can change the parameters that are being measured as well. To study the velocity characteristics of a gas flow, one must 'seed' the gas flow with enough sub-micron to several micron particles to make measurements possible, while at the same time not affecting or degrading the gas flow. This seeding requirement is often the most difficult requirement to achieve for accurate and reliable LDV measurements. Currently available atomization devices are used for seeding but typically do not yield the desired performance. A combination of low volume and inadequate atomization result in too few measurements in a desired period of time. For instance, to make high-speed measurements one must acquire several thousand measurements over the course of one minute. These measurements can then be averaged to provide accurate results.

The present invention comprises methods and devices capable of generating sprays with small, uniformly-sized droplets by superheated atomization. This atomizer was tested as a particle-seeding device for LDV measurements, and was shown to provide significant improvements in number of counts per minute and signal-to-noise ratios. The improvement is caused by the atomizer's superb ability to finely atomize liquid in precise doses by operating on a heat based atomization method as opposed to air induced atomization. In the superheated atomization, a pressurized liquid is raised to an elevated temperature in the atomization nozzle, resulting in a heated spray that is more resistant to re-condensation. This resistance proves beneficial as the atomized spray propagates to the measurement section without re-condensing. The improvements in particle seeding for LDV systems that are achieved using the present invention, can also be expected to improve measurements in other systems that use particle seeding, such as wind tunnel testing. To this end, the atomizer of the present invention was tested for atomizing a liquid with suspended particles. The particles used in the test were titanium dioxide in the 3–5 micron size range. The atomizer achieved excellent atomization and thereby uniform entrapment of the titanium dioxide particles in the air stream in a neutrally buoyant sense. These test results indicate that the atomizer can be used as a smoke generation device for wind tunnel testing. A steady, dense, repeatable and controlled volume smoke stream was easily producible with the atomizer.

It has been demonstrated that the atomizer of the present invention can achieve data rates that are two-orders of magnitude higher than data rates obtainable with conventional particle seeders. By optimizing fluid and gas flow rates, and the power input to the atomizer, further improvements in sensitivity can be obtained for a wide range of materials and particles. Furthermore, the use of the atomizer as a particle seeder for flow measurements will allow precise, on-the-fly control of the droplet size and density. Currently, solid seeding particles with fixed size distribution have to be replaced between the runs with different flow parameters requiring different particle sizes. In short, the atomizer can control droplet size and spatial distribution and optimize signal levels while reducing the particle interactions with the flow field.

Another application of the atomizer is in the field of flame and plasma based elemental analysis. In U.S. Pat. No. 5,997,956 issued Dec. 7, 1999 to Hunt et al., and entitled "CHEMICAL VAPOR DEPOSITION AND POWDER FORMATION USING THERMAL SPRAY WITH NEAR SUPERCRITICAL AND SUPERCRITICAL FLUID SOLUTIONS", one embodiment of the atomizer is used in conjunction with the CCVD process. In this coating process, precursors are dissolved in a solvent acting as the combustible fuel. This solution is atomized to form sub-micron droplets that are carried by an oxygen stream to the flame where they are combusted. The heat from the flame provides the energy required to evaporate the droplets and for the precursors to react and to deposit on the substrates. By modifying the CCVD system, measurements of the optical emission from excited species in the flame can be made, and these measurements can be analyzed for trace analysis. One such application includes flame based Atomic Emission (AE) spectroscopy. Two of the most commonly used analytical techniques for elemental analysis are Atomic Absorption spectroscopy (AA) and Ion Cyclotron Plasma Atomic Emission spectroscopy (ICP AE). AA instruments are relatively inexpensive but have somewhat limited sensitivity (detection limit). ICP AE has a much greater sensitivity than AA, but is much more expensive. It has been demonstrated that the present atomizer can produce flames for AE spectroscopy such that measurements are of sensitivities comparable to the state of the art AA results. This sensitivity was achieved without major modifications to the existing CCVD setup, and the resulting system was far from optimum. Through optimization of fluid and gas flow rates, atomizer settings, flame positioning, signal integration, and optics settings, significant improvements to sensitivity can be obtained. The atomizer of the present invention will achieve ICP AE quality results with an instrument that could very well sell in the price range of an AA. In atomic spectrometry, the efficient nebulization of organic solutions and the reduction of the mean drop size result in an increase of measurement sensitivity and analyte transport efficiency. Furthermore, the kinetics of the vaporization process that occurs in the measurement chamber are determined by the fraction of large aerosols present in the chamber, which is directly related to the mean diameter of the primary aerosol produced by the nebulizer.

The potential for using this atomization device in flame emission spectroscopy was put though preliminary testing using toluene solutions of known sodium concentrations. A fiber optic spectrometer was used to observe the intensity of the sodium "D" lines for solutions of different sodium concentration. The lowest concentration tested (1 ppm) was easily detectable, with the sodium lines having signal to noise ratios visually estimated to be well above 10:1 even at such low concentration. The system was found to be very sensitive to small changes due to factors such as spray uniformity, nozzle position, etc. The system of the present invention has a sensitivity that could rival ICP detection limits at a fraction of the cost in instrumentation. Further this system can use hydrocarbon solutions. To reduce background solvent peaks, the current invention can be used in a ICP system or with H-O flame. Other plasmas can also be used, such as microwave and electric arch plasmas. In such plasma systems improved sensitivity will result using the present invention from finer atomization and little or no dilution from atomizing or propagation gases.

The atomizer is also useful in the production of nanopowders (1–100 nm). There are many existing technologies for the production of fine powders, including chemical vapor condensation, flame-based condensation, and plasma processing. These techniques are useful for production of homogeneous and small-sized powder, but are very energy intensive and therefore expensive. Compared to these techniques, the present invention offers significant processing cost reduction. Furthermore, the atomizer process will also enable numerous nano-powder compositions that cannot be formed by conventional techniques. In liquid combustion vapor condensation (LCVC), low-cost, environmentally friendly, metal-bearing reagents are dissolved in solvents that also serve as combustible fuel. Using the atomizer of the present invention, this solution is atomized to form sub-micron droplets, which are then combusted in a torch, forming a vapor. The condensable species thus formed nucleate homogeneously as aerosol nano-powders that are then collected in dispersion media or on a solid collector. Premixed precursor solutions allow great versatility in synthesizing a wide variety of nano-powder compounds of very uniform size and composition. The LCVC method can produce nano-powders that are collected as colloidal dispersions, which is a convenient form for handling and subsequent processing. Applications that can benefit from the production of these nano-powders include near net shape ceramics, powder coating, and rheological fluids. Other applications of these high quality, multi-component nano-scale powders include electronic, optical, magnetic, mechanical and catalytic applications. For gas phase chemical processing, powders or nano-powders can be introduced to be reacted or act as a catalyst. Use of the atomizer with LCVC results in a simple and economical manufacturing process for a variety of advanced nano-phase powders.

Yet another useful application of the present atomizer is as a novel nebulizer for generating small-droplet sprays. The atomizer enables very fine atomization and vaporization of the liquid solvents and fuels, and complete and high-speed control of atomization, while utilizing an innovative combination of simple, robust components with modest power requirements. These features are useful for sample introduction in flame and inductively-coupled plasma atomic spectroscopy, as explained above, as well as many other equally important processes, including mass and atomic emission spectrometry, drug delivery, and fuel analysis and injection. In another chemical processing application, hazardous materials can be more finely and uniformly divided, to enable safer and more complete decomposition processing via thermal, plasma, flame or other reactors.

Spray drying technology is used in the generation of small-sized particles. The atomizer enables very fine atomization and vaporization of the liquid solvents and complete control of the degree of atomization. These features are useful in spray drying processes for production of pharmaceutical dry powders and atomization of suspensions and slurries for food and chemical products. This invention can also provide more efficient production of polymer powders with precise particle size. Spray-drying processes involve transforming a liquid into a dry powder particle. This is achieved by atomizing the fluid into a drying chamber, where the liquid droplets are passed through a hot-air stream and transformed into solid particles through a mechanism controlled by local heat and mass transfer conditions. These particles are then collected and stored for future use. The main objective of the atomizer is to produce a spray of high surface-to-mass ratio, droplets that can uniformly and quickly evaporate the water or other solvents. This step in the spray-drying process defines the primary droplet size and therefore significantly impacts the quality of the produced powder. In applications such as pulmonary delivery of protein and peptide therapeutics, the drug must be delivered in small sized particles to prevent exhalation or deposition on the upper airway. Other applications of the spray drying technique using the atomizer of the present invention include tile and electronic press powders that play an important role in the industrial development of high performance (advanced) ceramics. The ability to meet particle size distribution requirements, produce a spherical particle form, and handle abrasive feedstocks is an important reason for the widespread use of spray dryers in the ceramic industries. Spray dryers for the chemical industries also produce a variety of powdered, granulated and agglomerated products in systems that minimize formation of gaseous, particulate and liquid effluents. High efficiency scrubber systems and high performance bag filters prevent powder emission, while recycle systems eliminate problems of handling solvents, product toxicity, and fire explosion risks. Food products that are in powder or agglomerate form such as coffee/coffee substitutes, food colors, maltodextrine, soup mixes, spices/herb extracts, tea, tomato, vegetable protein, can be formed using spray drying. This application of the atomizer is useful as the formation of these heat sensitive products requires careful selection of the system and operation to maintain high nutritive and quality powders of precise specification.

The present invention also involves the atomization of fuels for delivery to combustion chambers to enhance the burning of these fuels, thereby increasing the fuel and thermal efficiency while reducing the amount of unburned hydrocarbon pollutants produced by the combustion. The methods and apparatus described herein are particularly beneficial when used to provide atomized fuel during the start and warm-up cycles of internal combustion engine operation, when fuel consumption and pollutant production are at their highest levels (it should be understood, however, that the invention is not intended to be limited to use with any particular fuel or combustion chamber, but has a wide range of useful applications). When the engine is operated prior to reaching its normal operating temperature (an action that is inherent to all engines that must be started), the ambient temperature internal surfaces of the engine (particularly the intake path) prohibit the fuel vaporization process, and even induce wetting of these surfaces. The non-vapor phase of the fuel does not burn, so a reduction in the vaporization of the fuel results in an increase in fuel consumption and the production of pollutants (namely unburned fuel), as well as a decrease in specific power efficiency. By routing the fuel through a small bore tube or chamber and rapidly heating the fuel in the tube, the present invention produces a finely atomized, heated fuel with droplets in the sub-micron to micron range. This highly atomized fuel bums thoroughly enough to reduce cold-start and warm-up emission levels to levels similar to those produced after the engine has reached operating temperature.

By providing heated, highly atomized fuel, the fuel atomizer of the present invention avoids wetting and puddling on the fuel injector, throttle body, intake walls, valves, valve stems, valve seats, valve relief, cylinder wall, cylinder head, spark plug, spark plug threads, piston lands, piston crevices, piston faces, piston rings and other internal engine surfaces. The liquid fuel that collects on these surfaces, not only increases fuel consumption by not burning but also acts as a heat sink, thereby prohibiting heat transfer to the engine and increasing engine warm-up time. The atomizer heats the fuel by directly contacting the fuel with the heating element at the point of injecting the fuel into the engine. The atomizer can be used to inject fuel in several different locations within the engine, either as a supplemental injector (i.e. cold start injector), or as the primary fuel injector. Fuel can be delivered into the intake manifold, port or directly into the combustion chamber, pre-chamber or stratification chamber. In addition, the atomizer can be configured to operate in any combination of these locations as a central port injector or as an individual component of a multi-port injection system, and either as a complete, variable flow, fuel delivery system or as a supplemental cold-start fuel injection system.

It should be noted that while the examples and data herein are predominately drawn toward gasoline burning, internal combustion engines, the atomizer is fully capable of producing atomized fuel for use with any combustion device and with other fuels as well. Examples of fuels include gasoline, diesel, kerosene, bio-fuels, heating oil or gas, A1, JP-5, and JP-8. Examples of useful applications include two and four stroke internal combustion engines, furnaces, turbines and heaters. There are an unlimited number of fuels and applications to which the present invention can be applied, and therefore it is not intended to limit the fuel atomizer to any particular application. To this end, the terms "combustion chamber" and "fuel" have been used herein to refer to any device that burns fuel, and can benefit from increased atomization of that fuel. As one of the most advantageous uses of the fuel atomizer embodiments of the present invention, however, is to reduce emissions and fuel consumption during start-up of internal combustion engines, this application has been the first to be investigated.

The atomizer of the present invention can be formed as several different embodiments. In the basic embodiment the atomizer is a heated tube or chamber. The method of heating the tube can be chosen from a number of different methods, including, but not limited to: direct electrical resistive heating (using a resistive tube or internal heating element); conductive heating (placing the tube in a block of material and then heating the block by a cartridge heater), by passing heated fluids over or through the block or other heating means); radiant heating using laser, infrared, microwaves or other radiant energy source(s); hot gases or liquids (oils, water, glycol), flames directed about the tube; or any combination of these and other known heating methods capable of achieving the required liquid temperature. Electrically resistive heating is preferred, as this provides a large range of controllable heating in a relatively small space. In the basic electrically heated embodiment, an electrically conductive/resistive tube or chamber is used. The term "tube" is intended to indicate a structure having an internal surface area that is small relative to the length of the structure. This can be better represented by defining the length to characteristic internal width (CIW) ratio. The CIW can be expressed as the square root of the average cross-sectional, internal area of the chamber. For example, a uniform square tube with 3 mm sides would have an average cross-sectional area of 9 $mm^2$, and a CIW of 3 mm. If this tube were 12 mm long, the length to CIW ratio would be 4. While some applications can operate with length to CIW ratios as little as 1, most applications require length to CIW ratios of 50 to 100 for proper atomization of the liquid to occur. Higher CIW ratios normally provide finer and more uniform droplets. CIW ratios even above 1000 are very useful. Higher CIW ratios increase the back pressure which can be helpful in some applications or limiting in others. The actual internal cross-sectional area and length required is dependent on the required liquid flow for the particular application. For a liquid flow of 25 ml/min., one may expect a defined ratio of 100. The outlet of the atomization device includes one or more liquid ports for delivering the atomized liquid to the required location, which is dependent on the particular application (smoke chamber, in-take manifold, etc.). In electrically heated embodiments, an electrode is attached either directly to an end of the device, to the connection fittings or to any conductive object in electrical contact with the heating element portion of the atomizer. A voltage is applied across the electrodes sending electrical current through the material around the chamber, (or an internal heating element), to thereby heat the material that is in direct contact with the liquid inside of the tube. As the liquid propagates through the device, its temperature increases rapidly to a level above the boiling temperature of the liquid at atmospheric conditions. However, since the liquid is kept at an elevated pressure, it remains in the liquid phase throughout the heating chamber. The pumping pressure used to drive liquid through the device acts to increase the boiling temperature of the liquid, thus allowing it to reach temperatures much higher than the boiling temperature of atmospheric liquid. Upon exiting the device, the heated liquid is in a metastable state and it rapidly expands in the surrounding atmospheric or reduced-pressure environment. This rapid expansion of hot liquid results in extremely fine atomization of the liquid. The electrical power applied in such a manner is adjustable to calibrate the heating of the tube so as to tailor the atomization to the particular liquid and/or application. Furthermore, this adjustment can be made "on-the-fly" to allow controlled atomization of different liquids, and/or combinations of liquids that have different atomization requirements, or to adjust the mean particle size and size distribution needed for the particular application. While the basic embodiment illustrated herein has a straight, circular cross-sectional configuration, other chamber shapes, such as coiled, bent, twisted or others can be used to suit the application and space requirements. It is also not required that the tube or chamber be circular in cross-section, but can be square, triangular, elliptical, etc. The atomizer may be made of a wide range of different materials depending on the desired resistivity, strength, thermal characteristics, etc.

In addition to the basic embodiment, several variations are disclosed herein. A further embodiment has a tube or body that is constructed of a non-electrically conductive material such as ceramic or glass. A central, heating wire or element extends along the longitudinal axis of the ceramic tube, thereby contacting and heating the liquid as it flows through the tube and about the heating device. The ceramic tube provides electrical and thermal insulation for the heating element and also provides structural strength for the heating wire or element. Other embodiments include a spirally shaped heating wire that extends along the inside surface of the chamber from one end to the other or within any section of the interior. Such a configuration provides additional surface area of heating element per length of chamber, as may be required for high flow rates or increased heating. One advantage of the ceramic or insulated chamber embodiment is the ability to use a wire heating element made of more efficient, yet potentially less robust material. Furthermore, the insulating material of the atomizer could be electrically as well as thermally insulating, thereby reducing heat transfer to surrounding components and increasing efficiency. As with the first embodiment, the delivery end of the ceramic tube can include one or more liquid delivery ports.

The above-described embodiments can also incorporate additional modifications designed to maximize the overall efficiency of the atomization device and the particular application. Any of the above atomizers could comprise multiple, series or parallel tubes. These tubes could be of alternating sizes, shapes, or cross-sections depending on the combustion chamber requirements or other factors. For example, the tubes or chambers could be of consecutively smaller diameter, with initial tubes or chambers of coiled configuration and a final tube with a straight configuration for targeting the liquid upon exiting the atomizer. The specific combination of tubes having similar or different diameters, cross-sections, lengths, thicknesses, configurations (coiled, bent, spiral, multi-tube twisted, etc.) and nozzle sizes would depend on the application.

Further modifications include the addition of materials on the outer surface of the atomizer. These materials could be integrated with the main tube and be in the form of increased tube thickness, or they may be in the form of a sleeve or sleeves of different materials (such as positive temperature coefficient (PTC) materials) coated, bonded, or otherwise attached to the outer surface of the atomizer. The function of these materials could be any combination of adding strength to the overall atomizer, acting as a heat sink or reservoir for temperature stabilization, and/or thermal/electrical insulation. The overall shape and size of the atomizer would be optimized for the application.

Many different materials may be used to produce the various components of the liquid atomizer of the present invention. The heating element (wire, tube, etc) can be any thermally/electrically conductive/resistive material that is not degraded by the liquid or the required heat and pressure. PTC material may be used for maintaining a specific temperature, as is well known in the art. In the electrically heated tube embodiments, stainless steel has had satisfactory results, in terms of conductivity, heat transfer, strength and liquid resistance. In electrically insulated tube embodiments, the tube can be made of any electrically insulating material that is not sensitive to the liquid atomized. Heat loss can be minimized by using a thermally insulating material or air gap and/or increasing the wall thickness of the tube.

A number of atomizer power control methods may be employed to control the temperature and pressure of the liquid, thereby changing the mean droplet size, droplet size distribution and other application specific factors. In some applications, partial boiling of the liquid may be preferred. As the temperature of the liquid increases, droplet size decreases and the amount of gas and vapor state of the liquid increases. Depending on the application, the wt % of these stable gases and vapors may be 1%, 5%, 10%, 20% or even as high as 40% of the total fluid exiting the chamber. An optimal thermodynamic state of the liquid exiting the nozzle (temperature and pressure) is selected on the premises of these factors. The level of atomization and liquid flow rate and properties, directly dictates the power requirement of the device. As with prior art devices, the required power level is determined by input-output comparative analysis, power to device, and level of atomization as determined by mean droplet size and uniformity per liquid type, as well as the heating method, materials used to form the atomizer, heat transfer rate and other factors. The device is capable of operating over a large range of power settings. Very low power settings result in average atomization and droplets in the range of 20–100 $\mu$m. However, high power levels result in sub-micron atomization. As previously described, the power setting can be adjusted during operation of the atomizer by simply changing the voltage applied to the material of the atomizer or the heating element. The power setting results in a particular maximum temperature of the liquid within the chamber (usually just as the liquid exits the chamber). This maximum temperature may be sustained for a short length of time from fractions of a millisecond to 0.01 or 0.1 second, or may be maintained for one second, 10 seconds or even as long as one minute, depending on the atomization properties of the liquid as well as the flow rate through the chamber. The pressure of the liquid entering the chamber is also controlled (by the upstream pump or pressure regulator), to provide a specific pressure drop between the entrance and exit of the chamber. A 10 psi drop may be adequate; however, 50 psi, 100 psi or even a 300 psi pressure drop may be required. Variation of CIW and CIW to length ratios can be used to realize the desired flow rate and desired back pressure. Some of the liquid atomization properties that determine the required temperatures and pressures include liquid and gas temperature and pressure relationships (such as the boiling point), surface tension, viscosity, and level and size of any suspended solids that may be in the liquid.

Accordingly, it is a first object of the invention to provide a controllable liquid atomization method for producing specific mean droplet sizes and droplet size distributions, depending on the specific application.

DETAILED DESCRIPTION OF THE PREFERRED EMBODIMENTS

Figure 1:
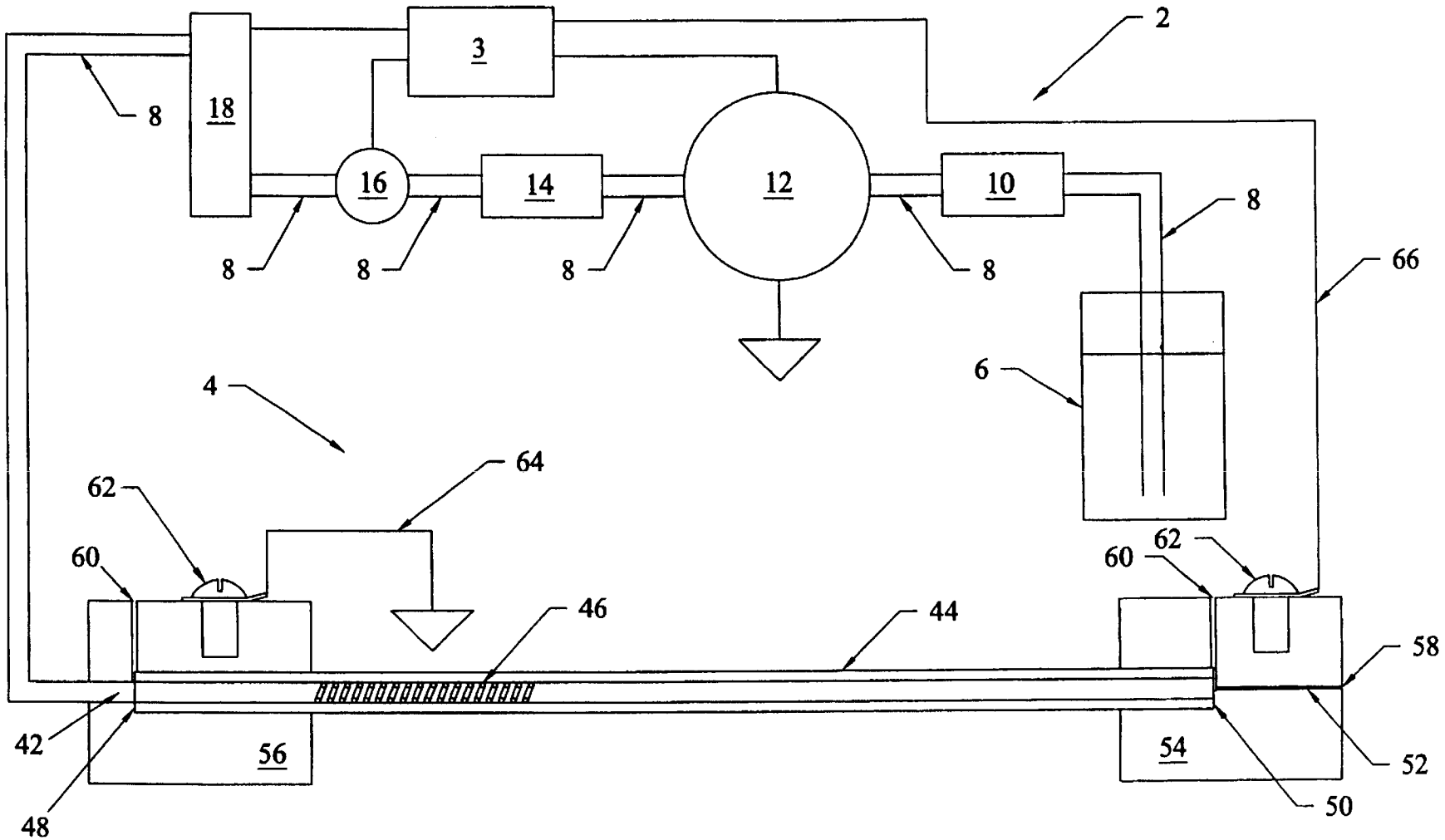
FIG. 1 is a combined schematic diagram and cross-sectional view of a liquid delivery system and an embodiment of the liquid atomizer, respectively, the cross-sectional view showing details of the atomizer of the present invention.

In FIG. 1, a generic liquid delivery system is indicated generally as 2. The delivery system 2 includes a liquid source 6 that contains the liquid that is to be delivered, the specific liquid used being dependent on the particular application. A liquid supply line 8 supplies the liquid to the input of a pump 12 via a pre-pump filter 10. The pump 12 directs the liquid through a post-pump filter 14, a regulating valve 16, and a flow meter 18, and finally to the input 42 of the atomizer 4. An electronic control unit 3, receives input signals from the flow meter 18 as well as other application-specific feedback signals. Based on these feedback signals, the control unit 3 determines the appropriate power to deliver to the pump 12 and to the atomizer 4 to control both the liquid flow rate as well as the level of atomization as is further described below. In addition, regulating valve 16 may be electronically adjustable so that the control unit 3 may control the liquid pressure "on-the-fly" should this be desired.

A particularly efficient embodiment of the liquid atomizer is indicated as 4 in FIG. 1. Liquid enters the atomizer 4 at input 42 in inlet block 56 and is directed into a first end 48 of a ceramic or glass tube 44. Within the ceramic tube 44 is a coiled heating element 46 that extends the length of the ceramic tube 44 (note that only a portion of the heating element 46 has been shown). As the liquid travels down the tube 44 it is progressively heated to achieve the desired temperature. The liquid exits the tube 44 at the other end 50 and is forced through a fine bore 52 in output block 54. Upon entering the bore 52, the pressure of the liquid decreases due to the friction loss in the bore 52, and upon exiting the bore 52 at outlet 58, the pressure of the liquid drops rapidly to ambient pressure, thus atomizing the liquid to produce a fine droplet spray. Inlet 56 and outlet 54 blocks are made of electrically conductive material and include bores 60 for insertion of the ends of the heating element 46. The bore 60 may only be an internal blind bore so as to eliminate any leakage yet still retain and hold the end of the coiled heating element 46 in contact with the inlet and outlet blocks. A fastener 62 (shown here as a screw in a threaded bore, although other fasteners may be used) connects electric wires 64 and 66 to the input 56 and output 54 blocks respectively. It should be noted that while wire 64 is shown connected to ground and wire 66 is connected to control unit 3, other configurations may be used. For example, it may be desirable to attach the control wire to input block 56 and have outlet block 54 contact system ground directly (such as an engine head in fuel injection applications).

Figure 2:
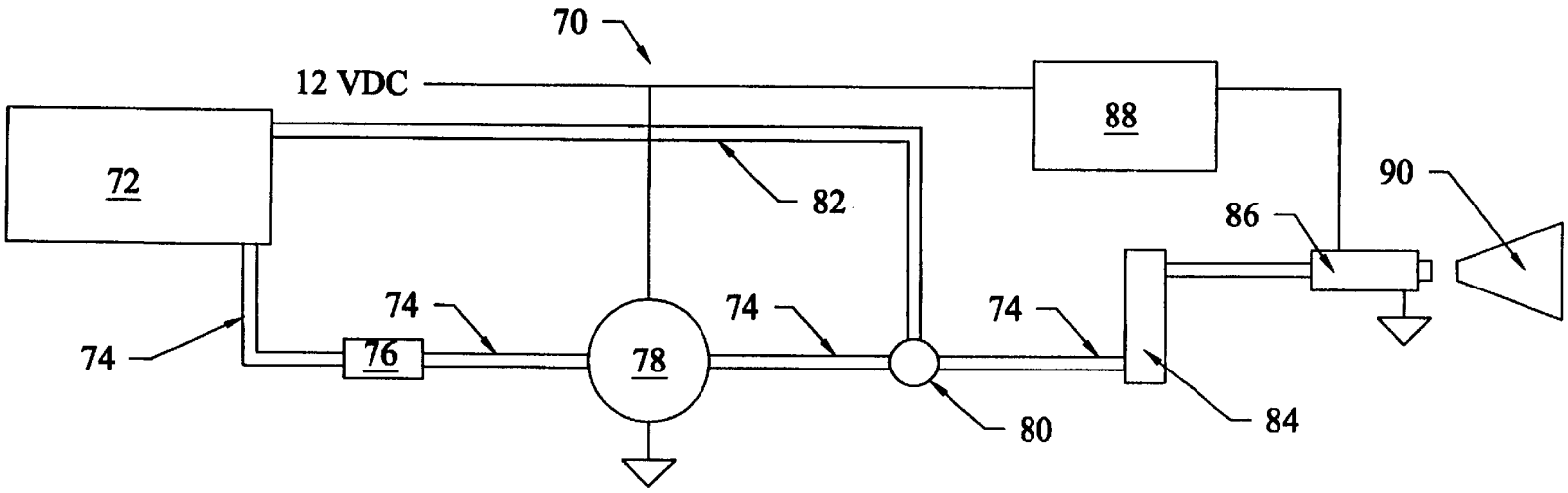
FIG. 2 is a schematic of a spray delivery system using the atomizer of the present invention.

A fuel delivery system 70 using the atomizer of the present invention is shown schematically in FIG. 2. A fuel tank 72 provides a storage container for the fuel (gasoline, diesel, JP-8, or other fuels), that is supplied to the inlet of a pump 78 via fuel line 74 and fuel filter 76. The pump 78 supplies fuel to a regulator 80, which returns excess fuel to the fuel tank 72 via return fuel line 82. A fuel flow meter provides a signal indicative of the fuel flow to atomizer 86. A control unit 88 supplies power to the atomizer based on the level of atomization required, fuel type and other conditions. The flow meter 84 may provide a signal to the control unit 88 to compensate for the fuel flow rate. The atomizer delivers a fine spray 90 to the combustion chamber, intake manifold or other engine locations, depending on the specific application and engine type. While the pump 78 and control unit 88 have been shown as being powered by 12 VDC it should be understood that other DC or AC voltages can be used depending on the vehicle type and provided voltages.

Figure 3:
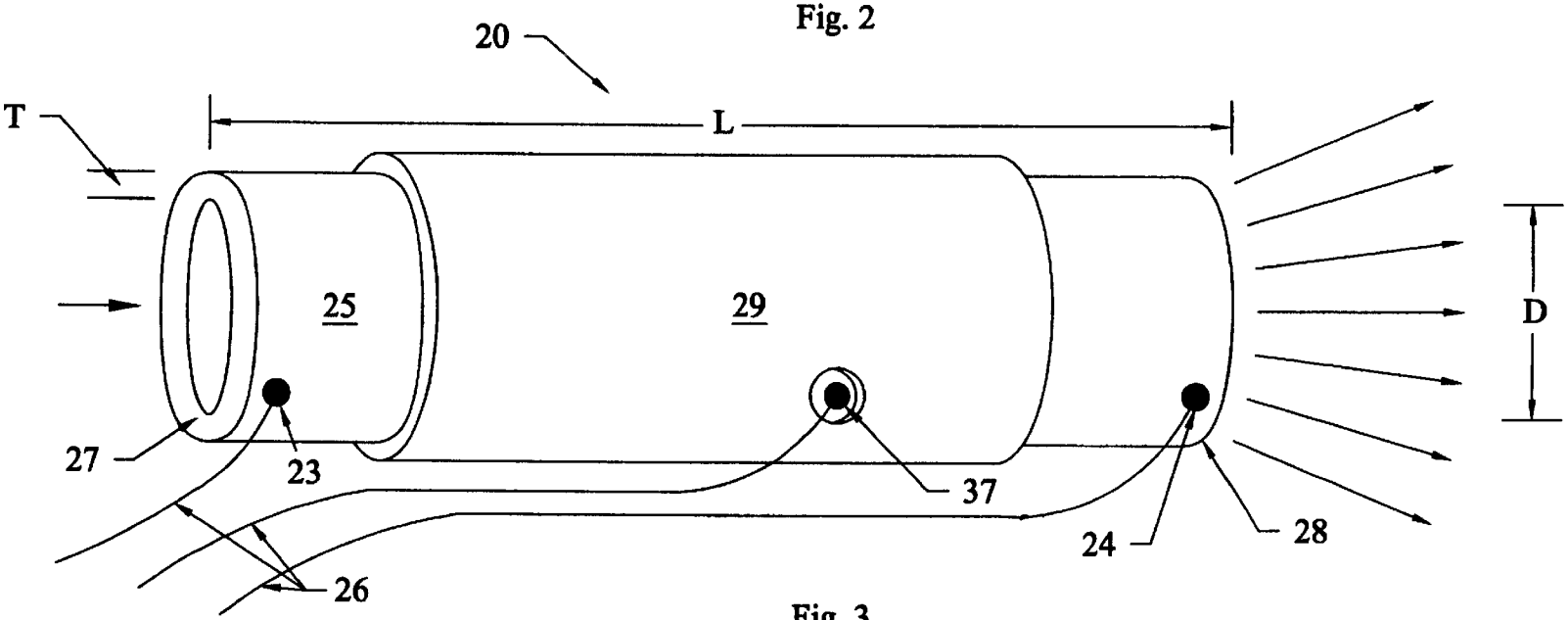
FIG. 3 is an isometric view of another embodiment of the liquid atomizer of the present invention.

Turning to FIG. 3, a detailed view of a simpler embodiment of the atomizer 20 is shown. This embodiment is basically a hollow tube 25 (shown here with a circular cross-section, although other shapes can be used), having a length L, an internal diameter D, a wall thickness T, an inlet end 27 and an outlet end 28. Tube 25 can be made of any electrical conductive/resistive material that increases in temperature when electrical current is passed therethrough. The actual material used is dependent on the overall size of the atomizer, liquid type, heating requirements, and other factors, although stainless steel has proved satisfactory. A pair of electrical wires 26 are connected to the tube 25, by electrical contacts 23 and 24, one at each end. The contacts 23 and 24 can be connected to the tube 25 by welding, soldering, or any other suitable means. As an integral part of a testing or particle manufacturing apparatus, the outlet end 28 could contact a metal portion of the apparatus to thereby provide a ground connection for the contact at the outlet end of the tube 25. In this configuration, a single electrical connection 23 at the inlet end 27 is all that is required. In another embodiment, both connections 23 and 24 are connected to ground and a central connection 37 provides a voltage potential. Central connection 37 can be located closer to connection 24, thereby increasing the resistance between connections 37 and 23 while decreasing the resistance between connections 37 and 24. This results in more current flowing between connections 37 and 24, and two levels of heating. By heating the liquid at a higher level closer to the outlet end 28, the likelihood of extended boiling the liquid in the tube is reduced. The physical mounting of the tube 25 can be provided by internal or external threaded portions of the tube 25, press fitting the tube or any other method that provides adequate strength while allowing liquid to freely flow therethrough.

In operation, liquid enters the inlet end 27 of the atomizer 20. Electrical current is passed through the tube 25 of the atomizer, thereby heating the material of the tube as well as the liquid in the tube, which is in direct contact with the internal walls of the tube 25. As the liquid continues through the tube 25, it remains in liquid form while increasing in temperature. Upon exiting the outlet end of the tube 25, the pressure of the liquid drops rapidly, resulting in atomization of the liquid. The atomized liquid thereby produced is comprised of extremely small droplets (on the order of a few microns) and is elevated in temperature, which reduces the possibility of condensation on internal surfaces of the testing apparatus. It should be understood that the temperature can be increased to the point that a two-phase flow (liquid and gas) can occur in the tube, or at even higher temperatures the liquid may be completely vaporized resulting in a gas output. While there may be applications where this is desirable, a major advantage of the atomizer of the present invention is the ability to control droplet size. This ability is lost once the liquid vaporizes to form atoms or molecules of the particular material. Also, dissolved materials are more likely to precipitate on the tube at vaporization temperatures and change the fluid flow through the tube. A sleeve 29 of additional material may be installed over the entire length of tube 25 or only along a portion of the tube 25. The sleeve 29 can simply add structural strength to the atomizer 20, or may provide electrical and/or thermal insulation between the atomizer 20 and other apparatus components.

Figure 4:
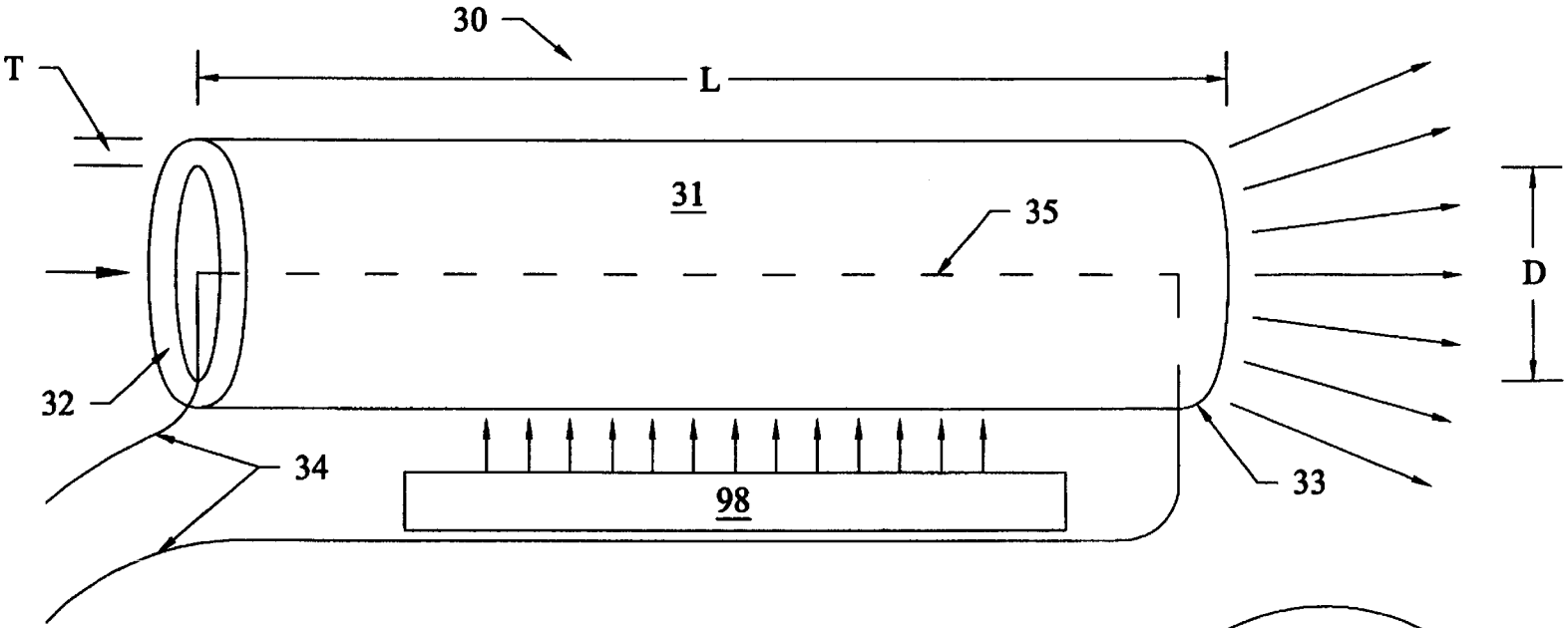
FIG. 4 is an isometric view of yet another embodiment of the liquid atomizer of the present invention.

FIG. 4 illustrates a further embodiment 30 of the atomizer of the present invention. As in the basic embodiment, the atomizer is constructed as a hollow tube 31 having an inlet end 32 and an outlet end 33. In this embodiment, however, tube 31 is preferably constructed of non-electrically conductive material such as ceramic. A centrally disposed heating element 35 extends along the central axis of tube 31 (although the heating element 35 could be off-center in some configurations). Power to she heating element 35 is provided by electrical wires 34, which are connected to each end of the heating element. Either end of the element 35 may be connected to a metal portion of the apparatus to provide a ground connection. The ends of the heating element 35 can be supported by extensions of the tube 31 itself, or by the fittings that support the tube 31. By disposing the heating element 35 within the tube 31, the liquid completely surrounds the heating element 35, thereby increasing the efficiency of the heating element 35 as opposed to heating the entire tube, which is only contacted internally by the liquid. Tube 31 provides structural strength to the heating element 35, while insulating the heating element 35 from electrically conductive apparatus components. Also in FIG. 4, an alternative heating means 98 is shown. Heating means 98 may comprise any number of radiant, conductive or other heating means as previously described. Depending on the heating requirements, these heat sources 98 may be used in conjunction with, or instead of, the electrically resistive heating means described above.

Figure 5:
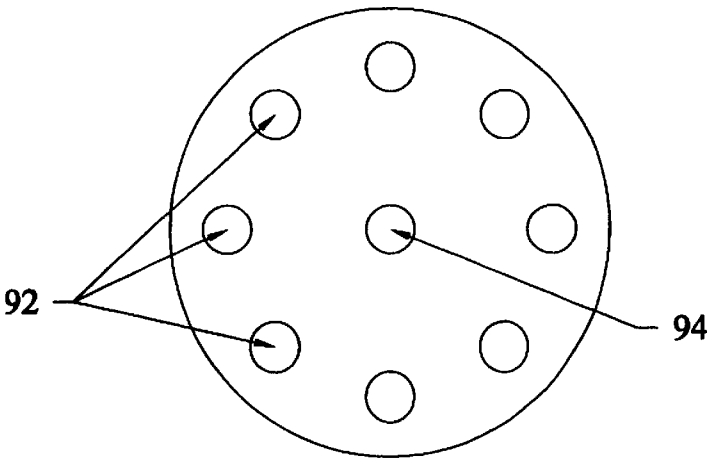
FIG. 5 is a front elevational view of the delivery end of the liquid atomizer.

Several different porting options for the outlet end of any of the above-described embodiments of the atomizer are illustrated in FIG. 5. While for extremely small diameter tubes, the outlet end may be completely open, in larger tubes, the outlet end is closed and includes a number of liquid delivery ports 92 and 94. In embodiments wherein the tube is the heating element, providing the ports 92 along the outer portion of the outlet end 50 results in dispensing the liquid that is closest to the heating element and therefore higher in temperature than the liquid in the center of the tube. In some embodiments it may be advantageous to provide a single, centrally located port 94, while in other embodiments, the location, number and configuration of the ports may be adjusted to maximize the efficiency of the atomizer. In applications wherein the liquid includes suspended particles, these ports 92 and 94 are sized with diameters at least twice that of the particles to avoid clogging.

Figure 6:
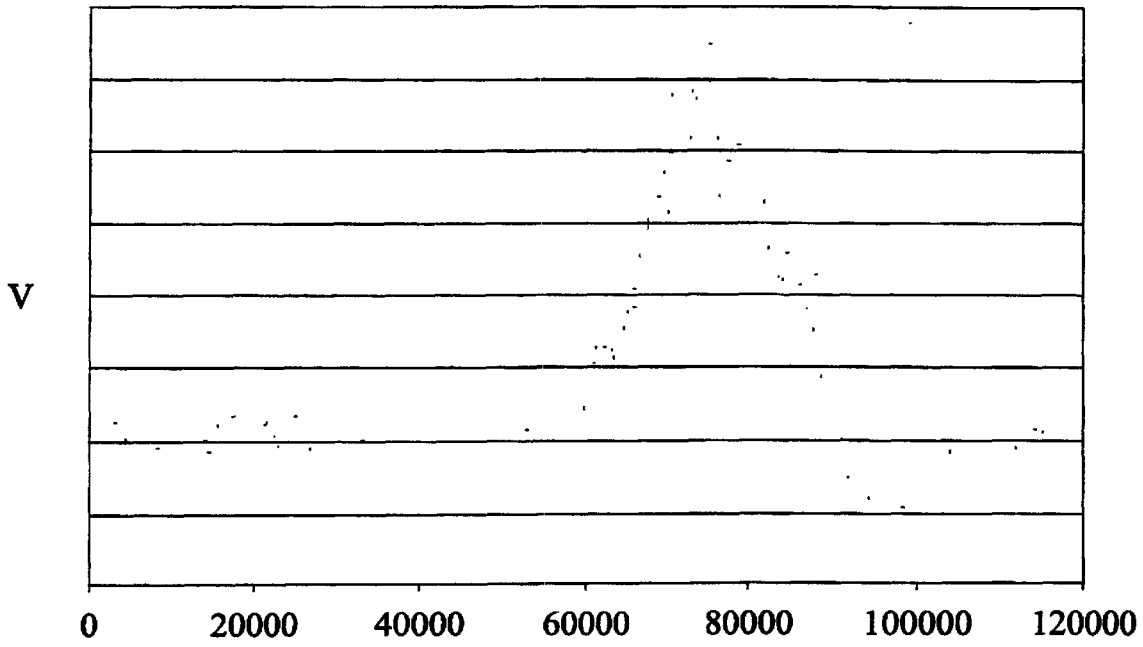
FIG. 6 shows the LDV results obtained using a prior art atomization device for particle seeding.

A commercially available, prior art atomization device was used with a modern LDV system to measure the intake air velocity in an intake runner of an automobile engine. The velocity measurements are made in coordination with engine crankshaft position. In the course of one minute, 78 measurements were made. The results are shown in FIG. 6, with each dot indicating one of the 78 data points. These results show the inadequacies of using the prior art atomization device for seeding.

Figure 7:
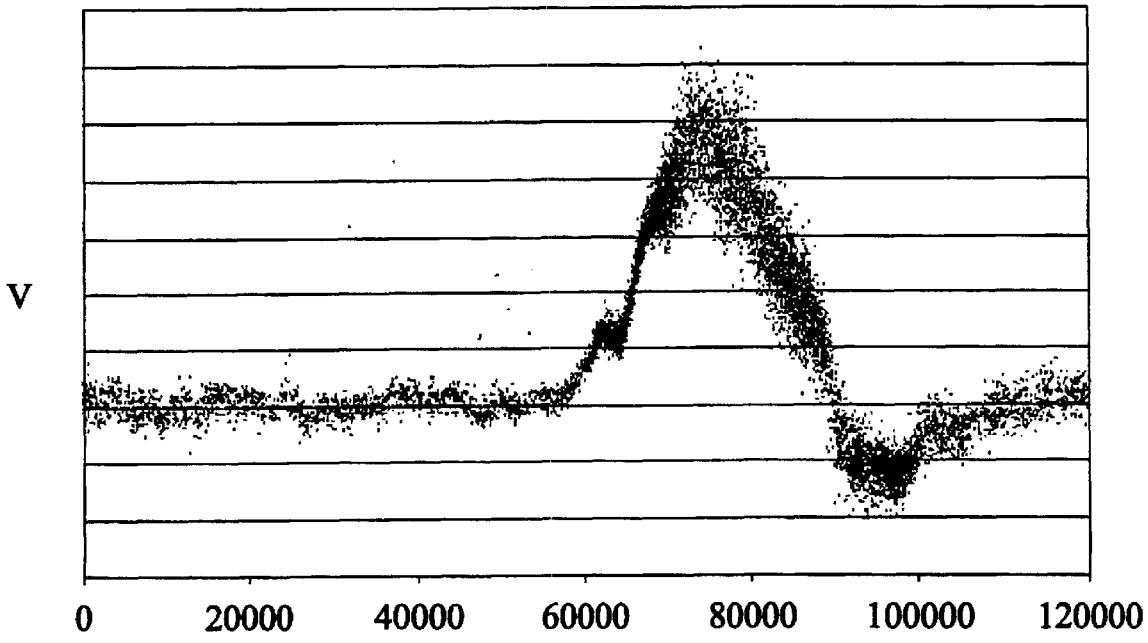
FIG. 7 shows the LDV results obtained using the atomization device of the present invention for particle seeding.

In the same LDV test configuration system as the prior art atomizer depicted in FIG. 6, the atomizer of the present invention was tested. The results are shown in FIG. 7. In a one minute test period, 10,000 measurements were achieved using the atomizer of the present invention as a seeding device. In contrast to the prior art results shown in FIG. 6, the present device provides very significant gains in particle seeding. These increased measurements are indicative of the large number of suitably sized particles fed into the air stream. Only properly sized particles reflect the laser to provide data measurements, while not affecting the air flow itself.

Figure 8:
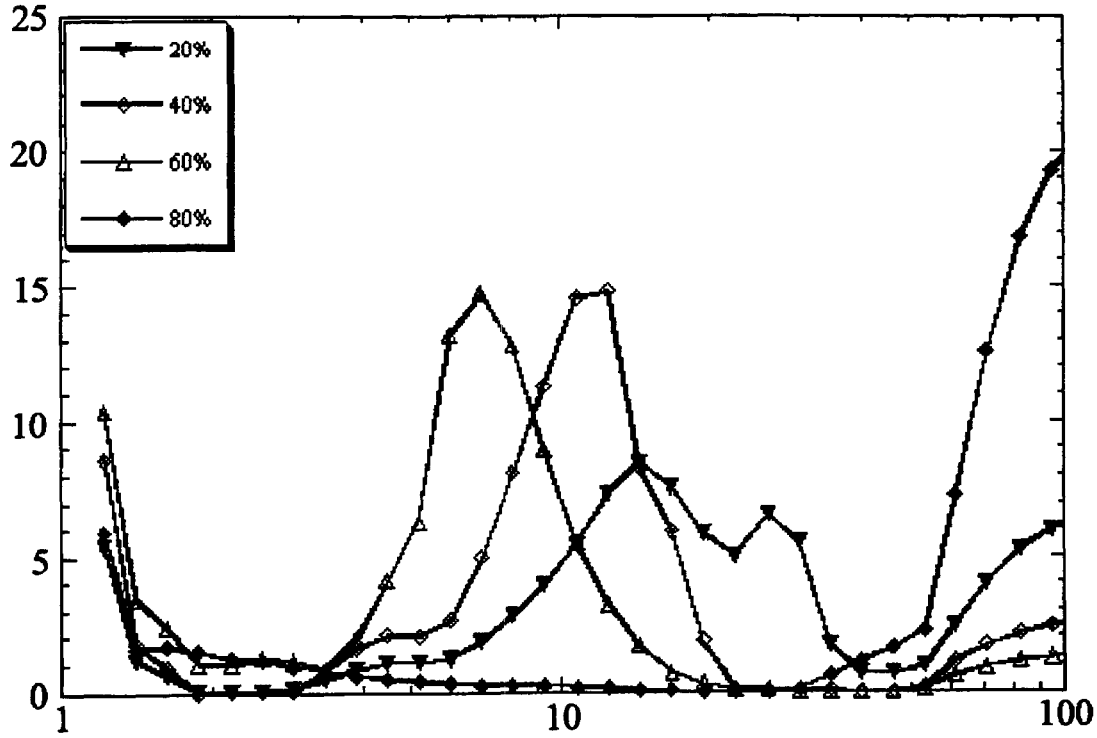
FIG. 8 shows droplet size distribution for alcohol at a flow rate of 4 mL/min for several power input levels to the atomizer.
Figure 9:
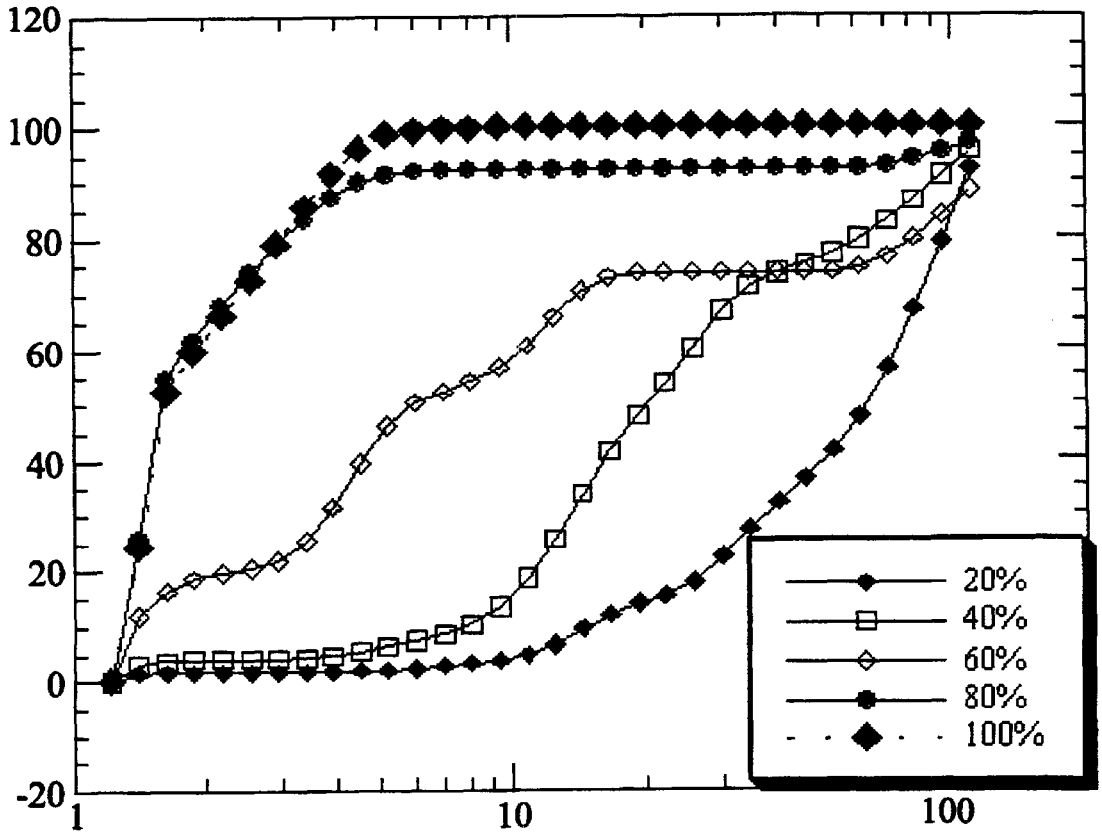
FIG. 9 shows accumulative droplet size distribution for alcohol at a flow rate of 4 mL/min for several power input levels to the atomizer.
Figure 10:
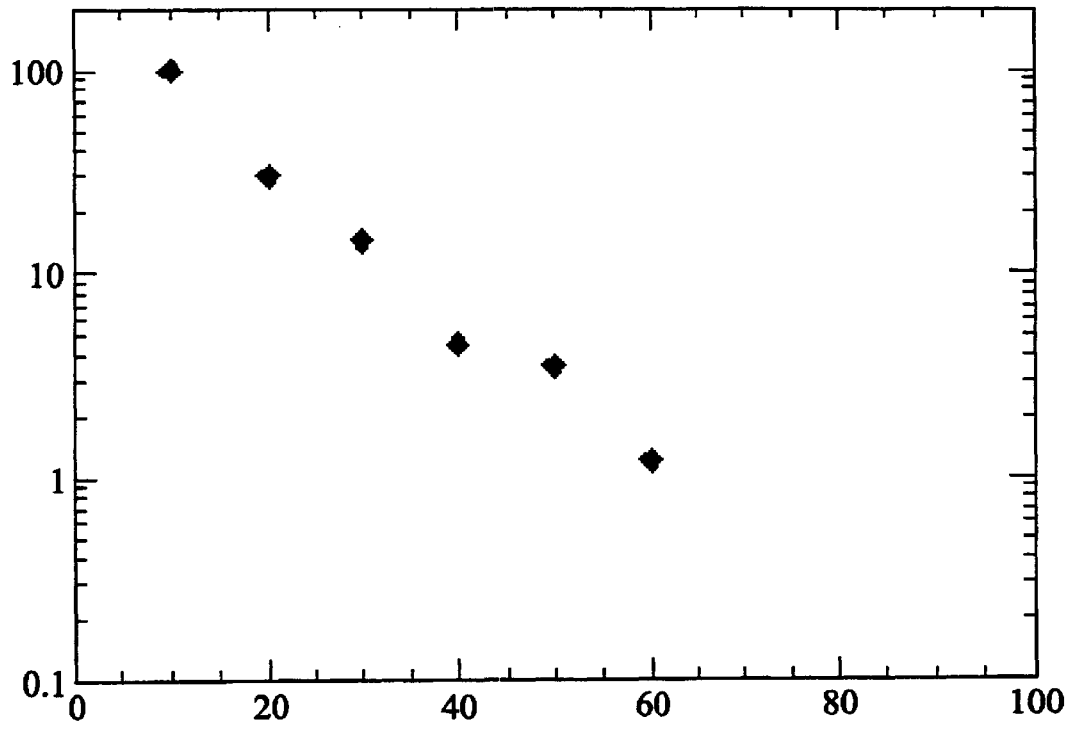
FIG. 10 shows mean droplet size distribution for isopropyl alcohol at a flow rate of 4 mL/min for several power input levels to the atomizer.

Droplet size measurements with the atomizer using organic solvents and using water were conducted. The measurements with organic solvents were made using a laser Fraunhofer diffraction system (Malvern Instruments Model 2600*c*), while a Phase Laser Doppler Analyzer (PDPA) was used to simultaneously determine droplet size distribution and velocity for experiments with water. FIG. 8 shows that the droplet size distribution can be controlled through adjustments of the atomizer power input. For the experiments discussed with respect to FIGS. 8–10, 100% of atomizer power is equal to 40 watts, although it should be understood that power levels above 40 watts may be used to provide the desired atomization. Also with respect to FIGS. 8–10, the following should be noted:

in FIG. 8 the vertical scale is % volume for particular size particles and the horizontal scale is the particle sizes in microns;

in FIG. 9 the vertical scale is % volume for all particles below a particular size and the horizontal scale is the particle sizes in microns (so for a power input of 100% (40 watts) all of the particles are below 4 microns in size); and in FIG. 10 the vertical scale is mean droplet size in microns and the horizontal scale is the % power input. This flexibility in selecting the droplet size is important in many applications, such as spray drying, particle coating, nanopowder production, and liquid fuel combustion. Extremely small droplets (the majority being in the sub-micron range and below the detection limit) can be generated in the higher range of atomizer device power inputs. For very low power input (20%), the droplet size distribution shows two pronounced peaks (below 30 $\mu$m) accompanied with the wider peak at droplet sizes above 100 $\mu$m. When the atomizer device power is increased to 60%, the peaks are shifted toward smaller droplet sizes and the major peak is centered around 4 $\mu$m. Under these operating conditions, more than 40% (by volume) of the aerosol had diameters of less than 4 $\mu$m (FIG. 9), despite the fact that no effort is made to correct for erroneous readings for droplet sizes below 1.2 $\mu$m. It is found that the droplet size distribution shifts from large droplets (20–40 microns) for low power inputs, to smaller droplets (2–10 microns) for modest power input. For higher power inputs, the majority of droplets are in the sub-micron range and the Malvern instrument was unable to properly capture droplet size distribution. Results presented here demonstrate that the aerosol produced by the atomizer device of the present invention is distributed over a very narrow range of droplet sizes and that the majority of the droplets are in the sub-micron range (below instrument detection) at higher power levels.

Figure 11:
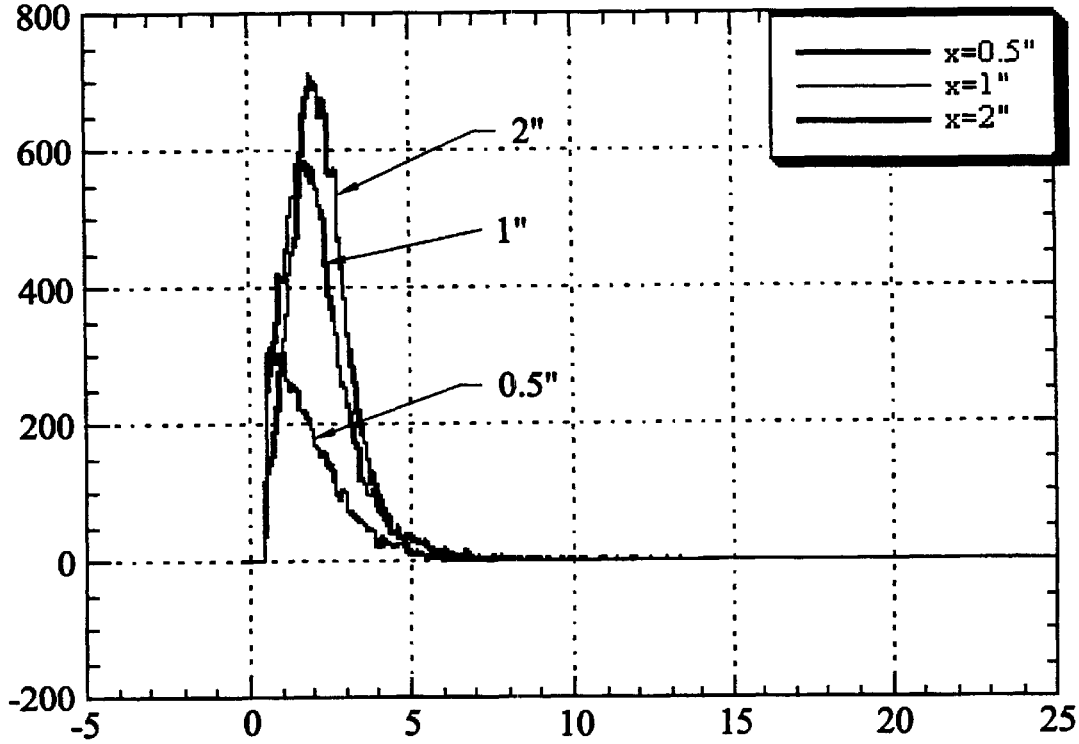
FIG. 11 shows droplet size distribution for water atomization near the spray edge at a high atomization level at different axial locations.

The mean droplet size decreases with increasing power input; thus, the atomizer performance can be optimized for different flow-rate and spray chamber requirements. Results indicate that mean droplet size decreases exponentially with increasing power input (FIG. 10). Measurements of the mean droplet size for different solvent flow rates (1–5 ml/min) indicate that smaller primary droplets result from increasing flow rate. Preliminary results indicate that the droplet size distribution is significantly narrower than in conventional pneumatic and ultrasonic nebulizers. Even under sub-optimal operating conditions, the distribution of droplet sizes using the present atomizer is limited to a few microns. FIG. 11 shows the droplet size distribution for water at the highest atomization setting (power input=40 watts) and at the centerline of the spray. The vertical scale is the particle count, while the horizontal scale is droplet size in microns. Notice that the droplet size distribution is very narrow for all axial locations. The mean droplet diameter is centered between 1 and 3 microns and there are very few droplets larger than 5 microns. The Sauter Mean Diameter (ratio of the third and second moment of the droplet size distribution) increases from approximately 1 $\mu$m at 0.5" away from the nozzle, to 2.5 $\mu$m at 1.5" away from the nozzle.

The above described test results indicate that beyond the simple increased atomization results achieved with the atomizer of the present invention, excellent control of mean droplet size and droplet size distribution can be realized. Power input to the atomizer can be varied, as well as fluid (liquids, suspensions and combinations of these) flow, to achieve the results required for the application. As previously described, the size and number of the atomizers or atomizer ports used can be customized for the particular liquid or application. For example, in smoke chambers used for aerodynamic testing, a number of atomizers may be used to show air flow along different portions of the article being tested. In smaller fluid flow tests, single atomizers may be adequate. When test flows vary from point to point, different size atomizers may be used at different positions to provide the most effective particle distributions. In the production of nano-powders, size, flow rates, power input and outlet port size can all be adjusted to produce the mean powder diameter and size distribution desired.

Figure 12:
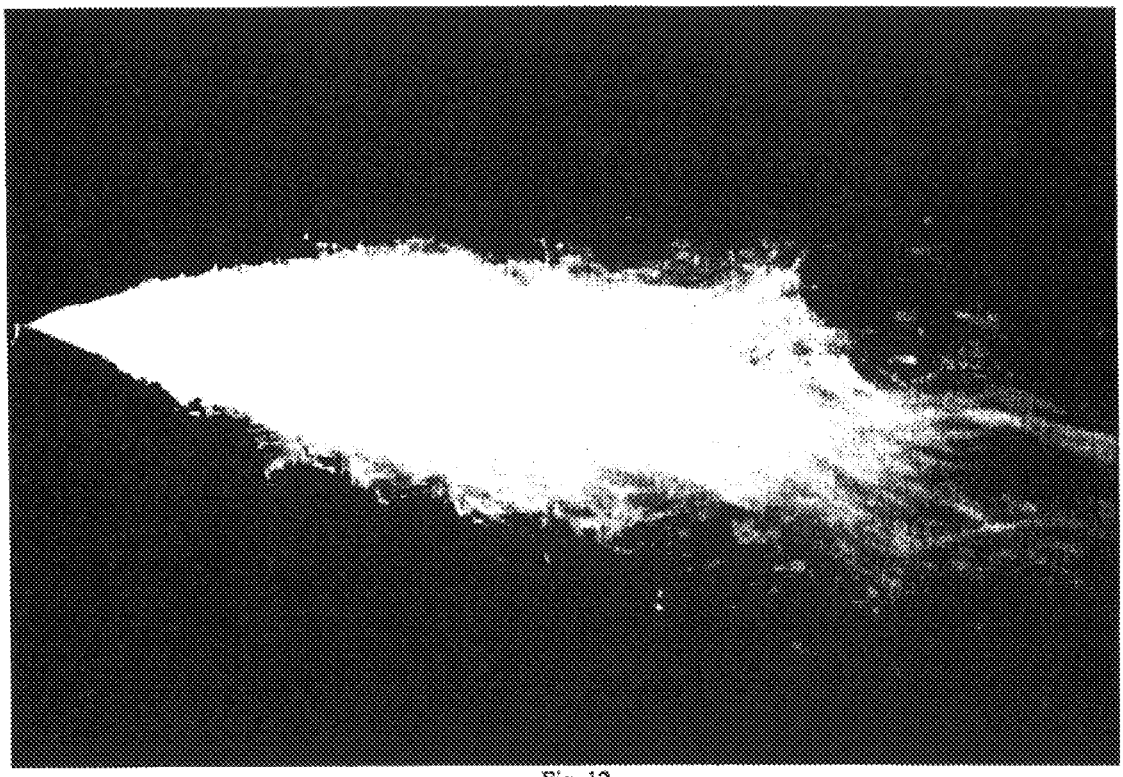
FIG. 12 is a picture showing the atomized spray produced using the atomizer of the present invention.

The ability of the different embodiments of the atomizer of the present invention to produce extremely small droplets is dramatically illustrated by the photograph shown in FIG. 12. The atomized spray exiting the atomizer has been illuminated to show the atomized liquid in contrast to the dark background. To the right of the photograph the atomized liquid has dispersed to the point of appearing as a "smoke", which is particularly useful in a number of the above-described applications.

Figure 13:
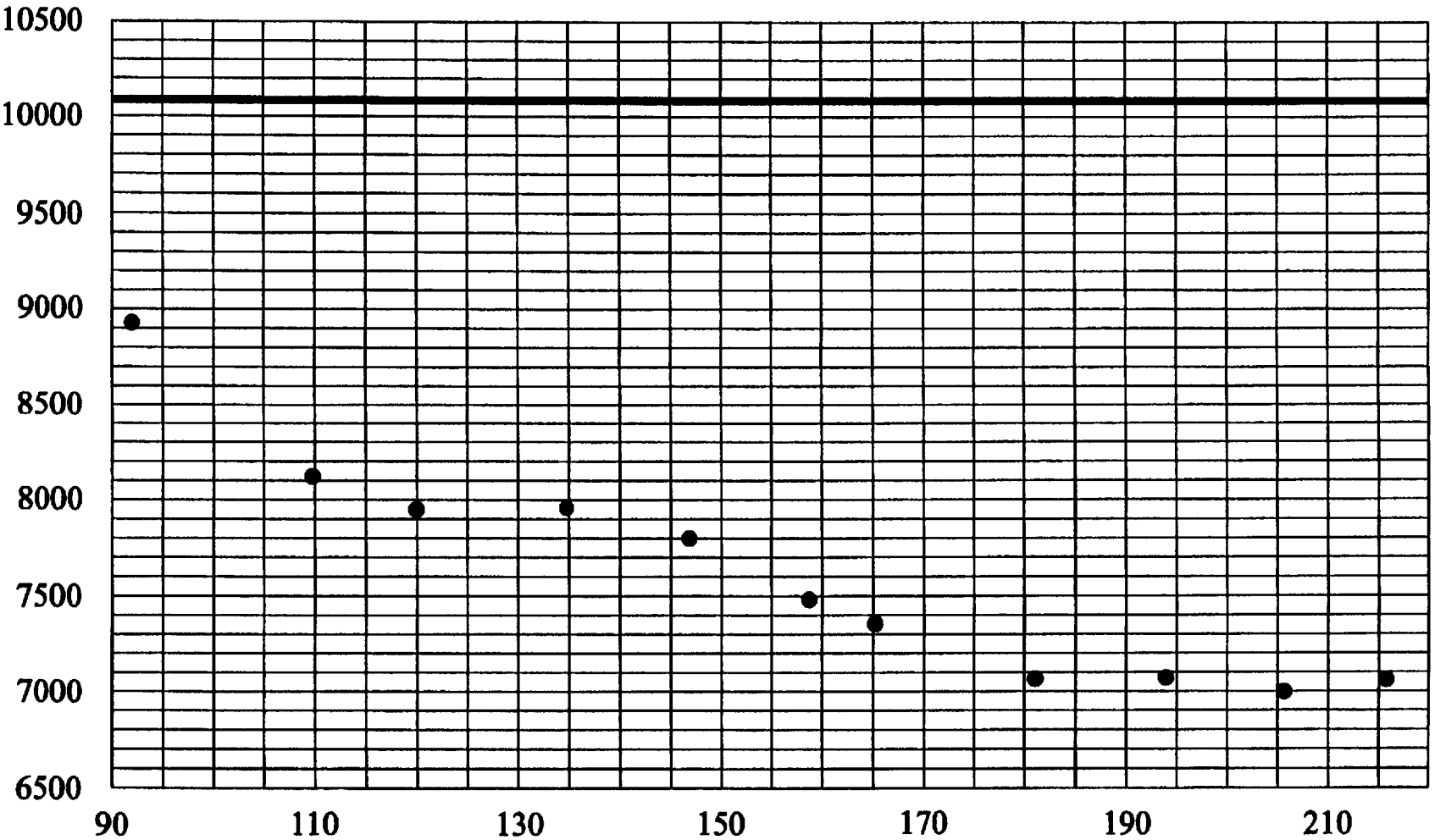
FIG. 13 is a graph of hydrocarbon emissions of an atomizer-equipped engine running at low, steady-state RPM, under full load, as a function of electrical power supplied to the fuel atomizer, and hydrocarbon emissions from a modern conventional electronic fuel injection (EFI) system under similar conditions, for comparison.

Testing of the basic embodiment of the atomizer for use in fuel atomization was conducted using a fully instrumented, twin cylinder, overhead cam, internal combustion engine coupled to an engine dynamometer. To simulate engine warm-up, tap water was used to cool the engine during steady-state operation until the water exiting the engine block stabilized at 20° C. Although engine warm-up is a transient event, the tests conducted are valid for a single point in time during the warm-up cycle. The test compared HC emissions between a standard injector and the atomizer for an engine running at 1200 RPM with a relatively high load (19 ft-lbs). The electrical power delivered to the atomizer tube was varied between approximately 90–215 watts. Results of the test can be seen in FIG. 13. The vertical scale indicates HC levels in parts per million (ppm), and the horizontal scale indicates power input to the atomizer in watts. For the electronic fuel injector, HC levels were measured at approximately 10,100 ppm. Emission levels for the atomizer were measured at approximately 8900 ppm when just over 90 watts of power was delivered to the atomizer tube. As power to the atomizer was increased, HC emissions reduced significantly up to about 180 watts of atomizer power. At that point HC levels were measured around 7100 ppm and did not reduce significantly when atomizer power was increased above 180 watts. It should be understood that this test was conducted at steady-state on a slightly warm engine. The most significant reduction of HC emissions, however, can be expected during the actual cold-start of the engine within the first few minutes of engine operation.

It is to be understood that the terminology used herein is for the purpose of describing particular embodiments only and is not intended to be limiting. It must be noted that, as used in the specification and the appended claims, the singular forms "a," "an" and "the" include plural referents unless the context clearly dictates otherwise.

Throughout this application, where publications are referenced, the disclosures of these publications in their entireties are hereby incorporated by reference into this application to more fully describe the state of the art to which this invention pertains.

What is claimed is:

1. A method for atomizing liquid, said method comprising the steps of:

(a) providing a chamber having a first end, a second end and an exit port, the exit port being unobstructed;

(b) routing pressurized liquid into the first end of the chamber;

(c) heating the liquid within the chamber; and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range and partial boiling occurs within the chamber.

2. The method of claim 1 wherein the liquid includes solid particles suspended therein, said solid particles being dispersed by the atomization of the liquid.

3. The method of claim 1 wherein the liquid is heated by passing heated fluid over or through a thermally conductive material that is thermally connected to the chamber.

4. The method of claim 3 wherein the heated fluid is an oil.

5. The method of claim 3 wherein the heated fluid is water.

6. The method of claim 3 wherein the heated fluid is glycol.

7. The method of claim 3 wherein the heated fluid is a flame.

8. The method of claim 3 wherein the heated fluid is a heated gas.

9. The method of claim 1 wherein the mean droplet size is less than 20 microns.

10. The method of claim 1, further comprising providing a sleeve surrounding said chamber.

11. A method for atomizing liquid, said method comprising the steps of:

(a) providing a chamber having a first end, a second end and an exit port, the exit port being unobstructed;

(b) routing pressurized liquid into the first end of the chamber;

(c) heating the liquid within the chamber; and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range; wherein the liquid is heated by passing an electrical current through material comprising the chamber, thereby heating the liquid in the chamber.

12. The method of claim 11 wherein the electrical current passed through the material surrounding the chamber is varied to adjust the heating of the liquid to:

(a) control the mean droplet size and the droplet size distribution of the atomized liquid;

(b) adjust for varying liquid flow rates; and/or (c) adjust for different liquids having different atomization properties.

13. A method for atomizing liquid, said method comprising the steps of:

(a) providing a chamber having a first end, a second end and an exit port, the exit port being unobstructed;

(b) routing pressurized liquid into the first end of the chamber;

(c) heating the liquid within the chamber; and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range, wherein said mean droplet size is between 1 and 20 microns.

14. The method of claim 13 wherein said mean droplet size is between 1 and 5 microns.

15. The method of claim 13 wherein said mean droplet size is between 5 and 20 microns.

16. A method for atomizing liquid, said method comprising the steps of;

(a) providing a chamber having a first end, a second end and an exit port, the exit port being unobstructed;

(b) routing pressurized liquid into the first end of the chamber;

(c) heating the liquid within the chamber, and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range; wherein the liquid at the exit of the chamber is in the form of droplets of the liquid as well as vapors and gases formed from the liquid and the stable gases and vapors at the exit of the chamber are composed of at least 1 wt % of the atomizing liquid.

17. The method of claim 16 wherein the stable gases and vapors are at the exit of the chamber are composed of at least 5 wt % of the atomizing liquid.

18. The method of claim 17 wherein the stable gases and vapors are at the exit of the chamber are composed of at least 10 wt % of the atomizing liquid.

19. The method of claim 18 wherein the stable gases and vapors are at the exit of the chamber are composed of at least 20 wt % of the atomizing liquid.

20. The method of claim 19 wherein the stable gases and vapors are at the exit of the chamber are composed of at least 40 wt % of the atomizing liquid.

21. A method for atomizing liquid, said method comprising the steps of:

(a) providing a chamber having a first end, a second end and an exit port, the exit port being unobstructed;

(b) routing pressurized liquid into the first end of the chamber, (c) heating the liquid within the chamber; and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range; wherein the liquid is at a least pressure at the first end of the chamber and is at a second pressure at the exit of the chamber, the first pressure being at least 10 psi above the second pressure.

22. The method of claim 21, wherein said step of providing a chamber comprises providing a chamber that is circular in cross-section.

23. The method of claim 21 wherein the liquid at the exit of the chamber is in the form of droplets of the liquid as well as vapors and gases formed from the liquid.

24. The method of claim 21 wherein the first pressure is at least 50 psi above the second pressure.

25. The method of claim 24 wherein the first pressure is at least 100 psi above the second pressure.

26. The method of claim 25 wherein the first pressure is at least 300 psi above the second pressure.

27. The method of claim 21 wherein the liquid includes solid particles suspended therein, said solid particles being dispersed by the atomization of the liquid.

28. A device for atomizing liquid, said device comprising:

(a) a chamber having a first end, a second end and an exit port, the exit port being unobstructed; and (b) means to control the temperature of the liquid within said chamber from a first point between said first and said second end, to said exit port; wherein the liquid is supplied under pressure to said first end and the liquid atomizes as it exits said exit port of said chamber, resulting in an atomized liquid spray exiting the chamber at the exit port such that the mean droplet size and the droplet size distribution of the atomized liquid are maintained within a desired range; wherein said means to control the temperature of the liquid includes a first electrical connection along said chamber, a second electrical connection along said chamber and spaced axially from said first electrical connection and a source of electrical power for providing a voltage across said electrical connections, the voltage across said connections induces an electrical current through material comprising said chamber, thereby directly heating the liquid within said chamber.

29. The device of claim 28 including means to vary the voltage across said connections, to adjust the heating of the liquid to:

(a) control the mean droplet size and the droplet size distribution of the atomized liquid;

(b) adjust for varying liquid flow rates; and/or (c) adjust for different liquids having different atomization properties.

30. The device of claim 28, wherein the means to control the temperature of the liquid includes a third electrical connection at said first end of said chamber.

31. A method for atomizing liquid, said method comprising the steps of:

(a) providing a chamber having a first end, a second end and an exit port, the exit port being unobstructed;

(b) routing pressurized liquid into the first end of the chamber;

(c) heating the liquid within the chamber, and (d) controlling the temperature of the liquid from a first point between the first end and the second end, to the exit port of the chamber resulting in an atomized liquid spray exiting the chamber at the exit port such that the mean droplet size and the droplet size distribution of the atomized liquid are maintained within a desired range; wherein the liquid is at a particular temperature at the exit of the chamber, the liquid in the chamber being at or above this temperature for less than one second.

32. The method of claim 31 wherein the mean droplet size is less than 20 microns.

33. The method of claim 31 wherein the liquid is at a particular temperature at the exit of the chamber, the liquid in the chamber being at or above this temperature for less than 0.01 second.

34. The method of claim 31 wherein the liquid is at a particular temperature at the exit of the chamber, the liquid in the chamber being at or above this temperature for less than 0.1 second.

35. A device for atomizing liquid, said device comprising:

(a) a chamber having a first end, a second end and an exit port, the exit port being unobstructed; and (b) means to control the temperature of the liquid within said chamber from a first point between said first and said second end, to said exit port; wherein the liquid is supplied under pressure to said first end and the liquid atomizes as it exits said exit port of said chamber, resulting in an atomized liquid spray exiting the chamber at the exit port such that the mean droplet size and the droplet size distribution of the atomized liquid are maintained within a desired range; wherein the liquid is at a first pressure at the first end of the chamber and is at a second pressure at the second end of the chamber, the first pressure being at least 10 psi above the second pressure.

36. The device of claim 35, wherein said chamber is circular in cross-section.

37. The device of claim 35, further comprising a sleeve surrounding said chamber.

38. The device of claim 35, wherein said exit port includes a plurality of exit ports to allow the liquid to exit said second end of said chamber.

39. The device of claim 38 wherein the liquid includes suspended particles the particles having a particular diameter, said plurality of exit ports each having a diameter at least twice the diameter of the suspended particles.

40. The device of claim 35, wherein said second end of said chamber is open.

41. A method for atomizing fuel, said method comprising the steps of:

(a) providing a chamber having a first end, a second end, an unobstructed exit port and a length to characteristic internal width CIW ratio of at least 10;

(b) routing pressurized fuel into the first end of the chamber; and (c) directly heating the fuel within the chamber from a first point between the first and the second end, to the exit port; wherein the fuel atomizes as it exits the exit port of the chamber.

42. A device for atomizing fuel, said device comprising:

(a) a chamber having a first end, a second end, an unobstructed exit port and a length to characteristic internal width CIW ratio of greater than 10; and (b) means to directly heat the fuel within said chamber from a first point between the first and the second end, to the exit port; wherein the fuel is supplied under pressure to said first end and the fuel atomizes as it exits said exit port of said chamber.

43. The device of claim 42 wherein said chamber has a length to CIW ratio of greater than 20.

44. The device of claim 43 wherein the chamber has a length to CIW ratio of greater than 50.

45. The device of claim 42, wherein said second end of said chamber is open.

46. The device of claim 42, wherein said exit port includes a plurality of ports.

47. The device of claim 42, further comprising a sleeve surrounding said chamber.

48. The device of claim 42, wherein said chamber is circular in cross-section.

* * * * *